US010541498B2

(12) United States Patent
Zhao et al.

(10) Patent No.: US 10,541,498 B2
(45) Date of Patent: Jan. 21, 2020

(54) ELECTRICAL CONNECTOR HAVING A SHIELDING SHELL WITH A REAR SHELL PART AND A FRONT SHELL PART

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/989,183

(22) Filed: May 25, 2018

(65) Prior Publication Data

US 2018/0342839 A1 Nov. 29, 2018

(30) Foreign Application Priority Data

May 26, 2017 (CN) ..... 2017 1 0384246

(51) Int. Cl.

| | |
|---|---|
| ***H01R 13/648*** | (2006.01) |
| ***H01R 13/6585*** | (2011.01) |
| *H01R 24/60* | (2011.01) |
| *H01R 13/52* | (2006.01) |

(52) U.S. Cl.
CPC ..... *H01R 13/6585* (2013.01); *H01R 13/5202* (2013.01); *H01R 24/60* (2013.01)

(58) Field of Classification Search
CPC . H01R 13/6585; H01R 13/5202; H01R 24/60
USPC ..... 439/607.27
See application file for complete search history.

(56) References Cited

U.S. PATENT DOCUMENTS

| | | | | |
|---|---|---|---|---|
| 8,388,380 | B1 * | 3/2013 | Van der Steen | H01R 13/5202 439/607.36 |
| 9,496,653 | B2 * | 11/2016 | Little | H01R 12/724 |
| 9,640,911 | B2 * | 5/2017 | Chen | H01R 13/642 |
| 9,666,964 | B2 * | 5/2017 | Tsai | H01R 12/716 |
| 9,742,098 | B2 * | 8/2017 | Zhao | H01R 13/5202 |
| 9,755,370 | B2 * | 9/2017 | Little | H01R 13/6581 |
| 9,853,393 | B2 * | 12/2017 | Guo | H01R 13/405 |
| 9,997,853 | B2 * | 6/2018 | Little | H01R 13/6471 |
| 9,997,866 | B1 * | 6/2018 | Hsu | H01R 13/5202 |
| 10,050,373 | B2 * | 8/2018 | Wang | H01R 13/5219 |
| 2016/0181722 | A1 | 6/2016 | Tsai et al. | |
| 2017/0201048 | A1 | 7/2017 | Kong et al. | |
| 2017/0201053 | A1 | 7/2017 | Guo et al. | |

FOREIGN PATENT DOCUMENTS

| | | |
|---|---|---|
| CN | 104538781 | 4/2015 |
| CN | 105680246 | 6/2016 |
| CN | 105680247 | 6/2016 |

* cited by examiner

*Primary Examiner* — Abdullah A Riyami
*Assistant Examiner* — Vladimir Imas
(74) *Attorney, Agent, or Firm* — Wei Te Chung; Ming Chieh Chang

(57) ABSTRACT

An electrical connector includes: an insulative housing having a base and a tongue; an upper and lower rows of contacts mounted in the insulative housing and exposed to two opposite surfaces of the tongue; and a shielding shell enclosing the insulative housing, wherein the shielding shell has a rear shell part and a front shell part, and the rear shell part has a seamless annular portion accommodating the base.

11 Claims, 12 Drawing Sheets

ELECTRICAL CONNECTOR HAVING A SHIELDING SHELL WITH A REAR SHELL PART AND A FRONT SHELL PART

BACKGROUND OF THE INVENTION

1. Field of the Invention

The present invention relates to an electrical connector having an insulative housing, an upper and lower rows of contacts mounted in the insulative housing, and a shielding shell enclosing the insulative housing, wherein the shielding shell has a rear shell part and a front shell part and the rear shell part has a seamless annular portion accommodating a base of the insulative housing.

2. Description of Related Arts

U.S. Patent Application Publication No. 2016/0181722 discloses an electrical connector including an insulative housing having a base and a tongue, an upper and lower rows of contacts mounted in the insulative housing and exposed to two opposite surfaces of the tongue, and a metallic shell enclosing the insulative housing. The metallic shell is tubular and is formed by stamping or deep drawing. The metallic shell is a seamless shell and defines a receiving cavity therein.

U.S. Patent Application Publication No. 2017/0201053 discloses a similar type of electrical connector including a metallic shield. The metallic shield is made via powder metallurgy and includes a main body, a tubular section extending from the main body, and an inner part extending from the main body inside the tubular section. The main body has a vertical connecting wall.

SUMMARY OF THE INVENTION

An electrical connector comprises: an insulative housing having a base and a tongue; an upper and lower rows of contacts mounted in the insulative housing and exposed to two opposite surfaces of the tongue; and a shielding shell enclosing the insulative housing, wherein the shielding shell has a rear shell part (51) and a front shell part (52), and the rear shell part has a seamless annular portion accommodating the base.

DETAILED DESCRIPTION OF THE PREFERRED EMBODIMENT

Figure 1:
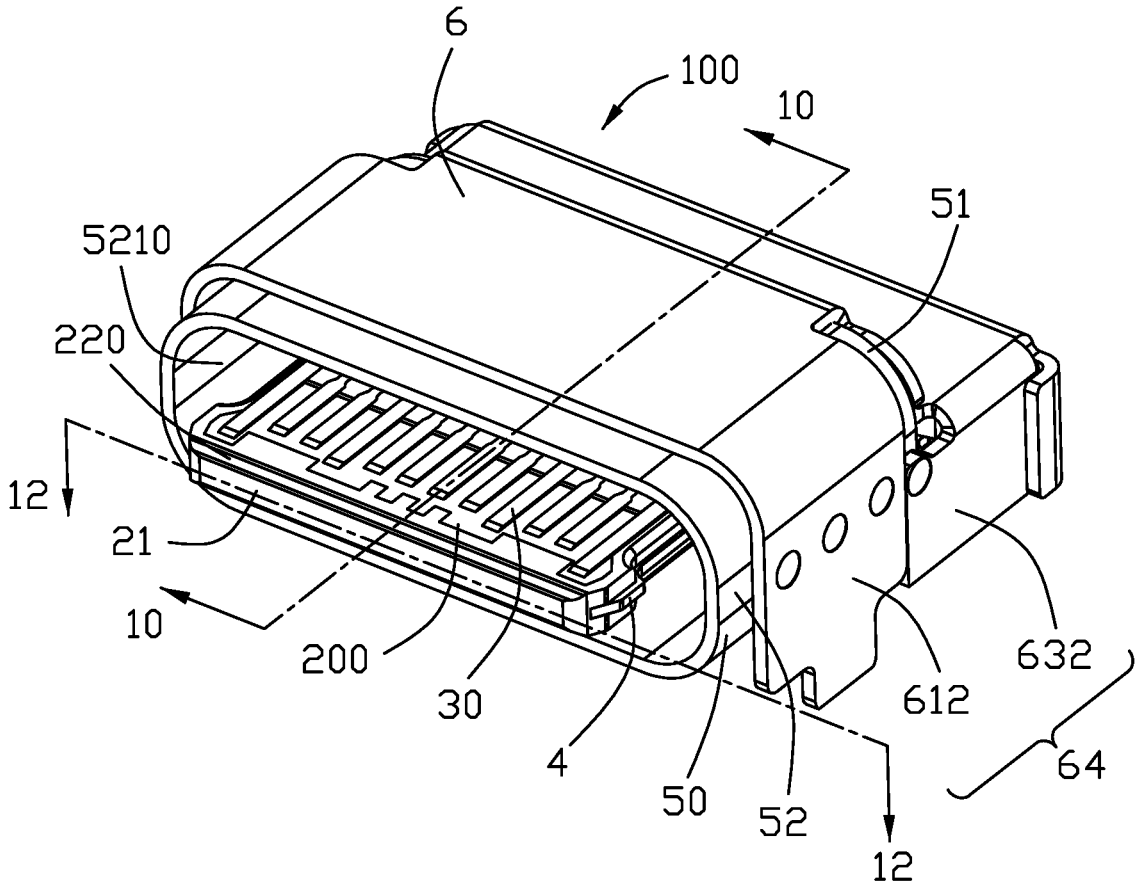
FIG. 1 is a front perspective view of an electrical connector in accordance with the present invention.
Figure 2:
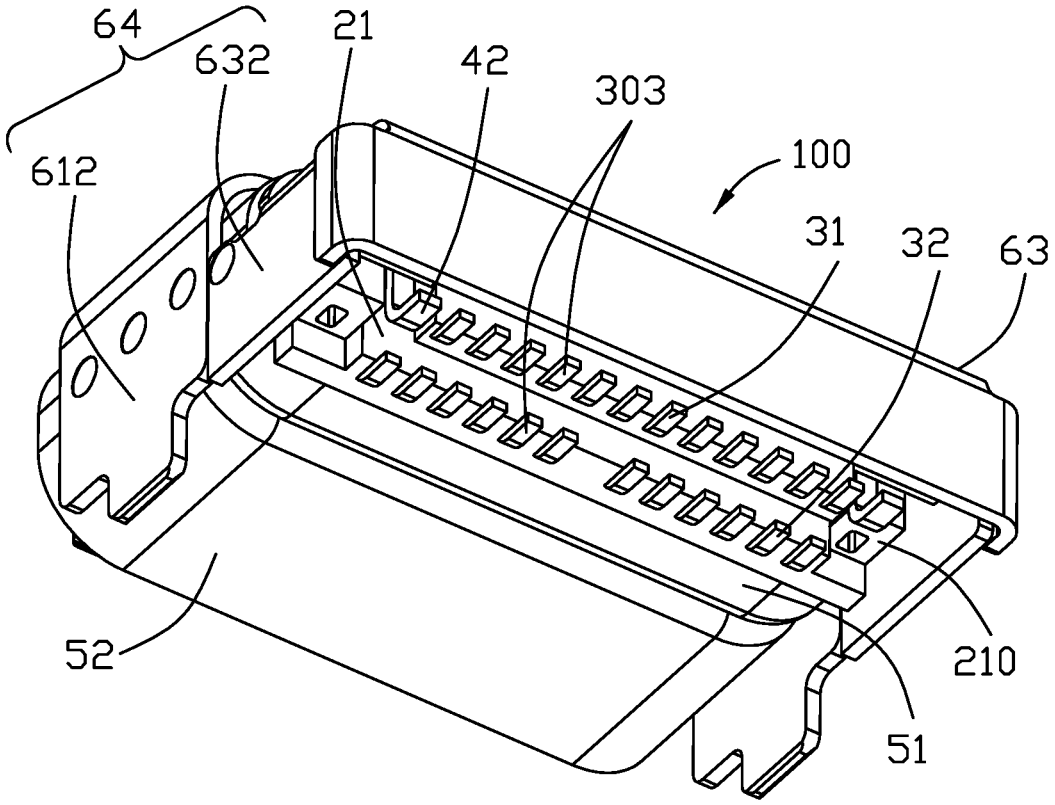
FIG. 2 is a rear perspective view of the electrical connector.
Figure 3:
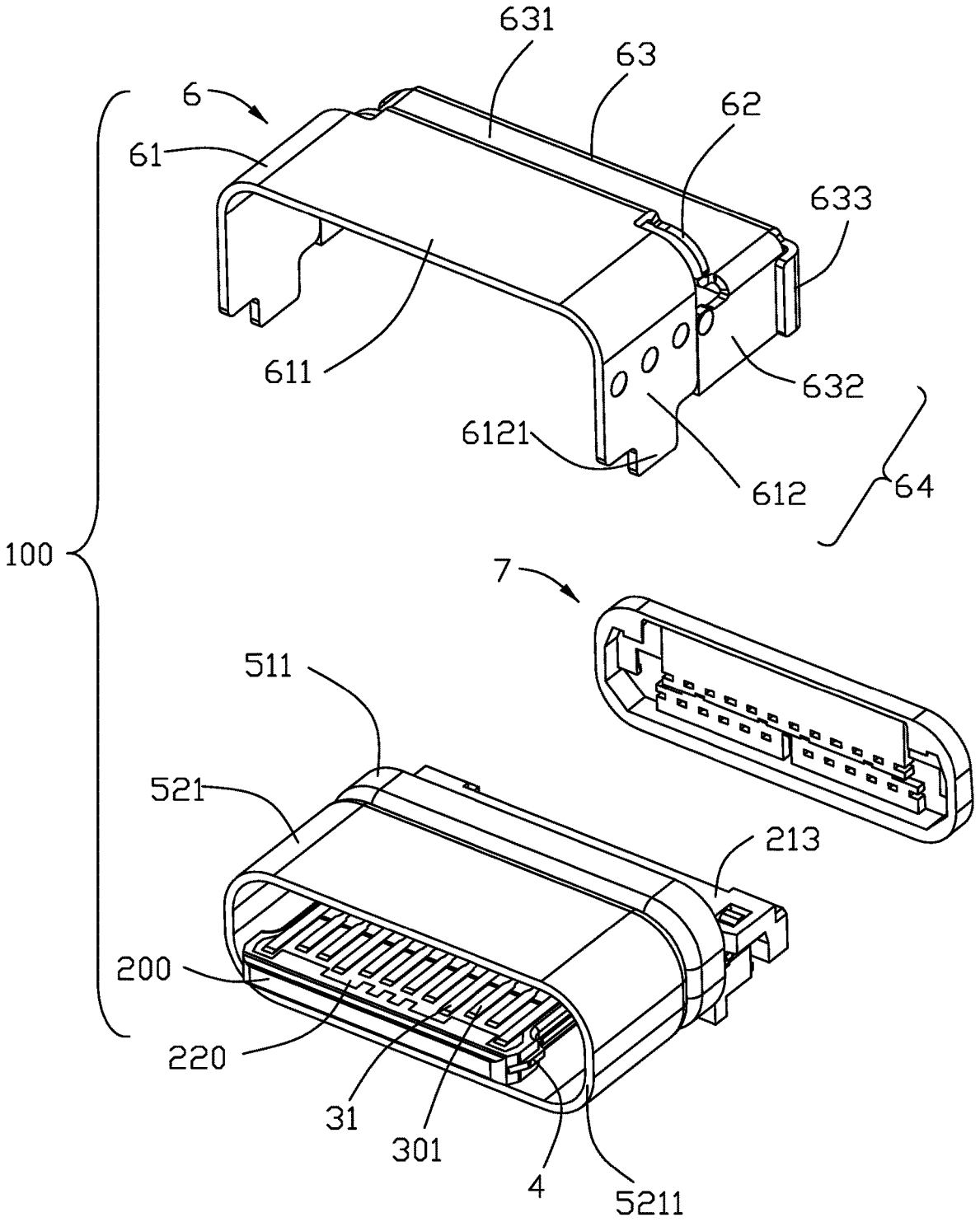
FIG. 3 is an exploded view of the electrical connector.
Figure 4:
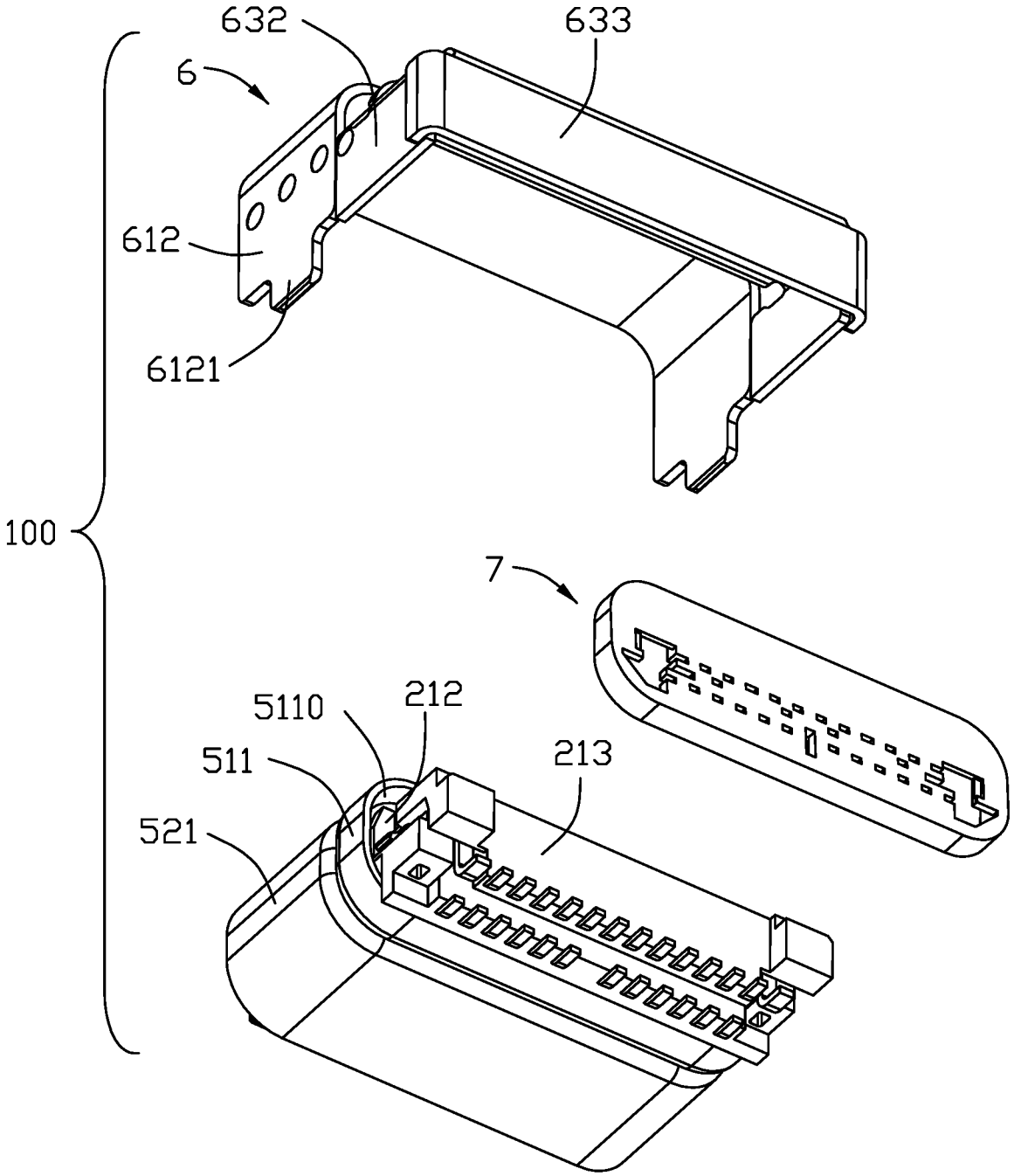
FIG. 4 is another exploded view of the electrical connector.
Figure 5:
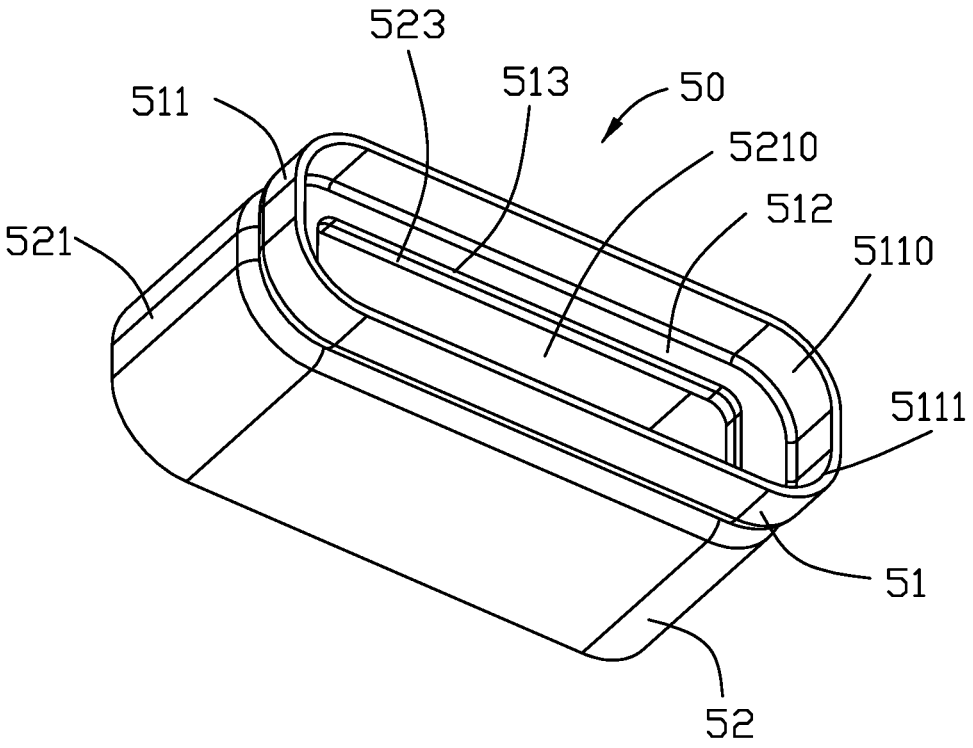
FIG. 5 is a rear perspective view of a shielding shell of the electrical connector.
Figure 6:
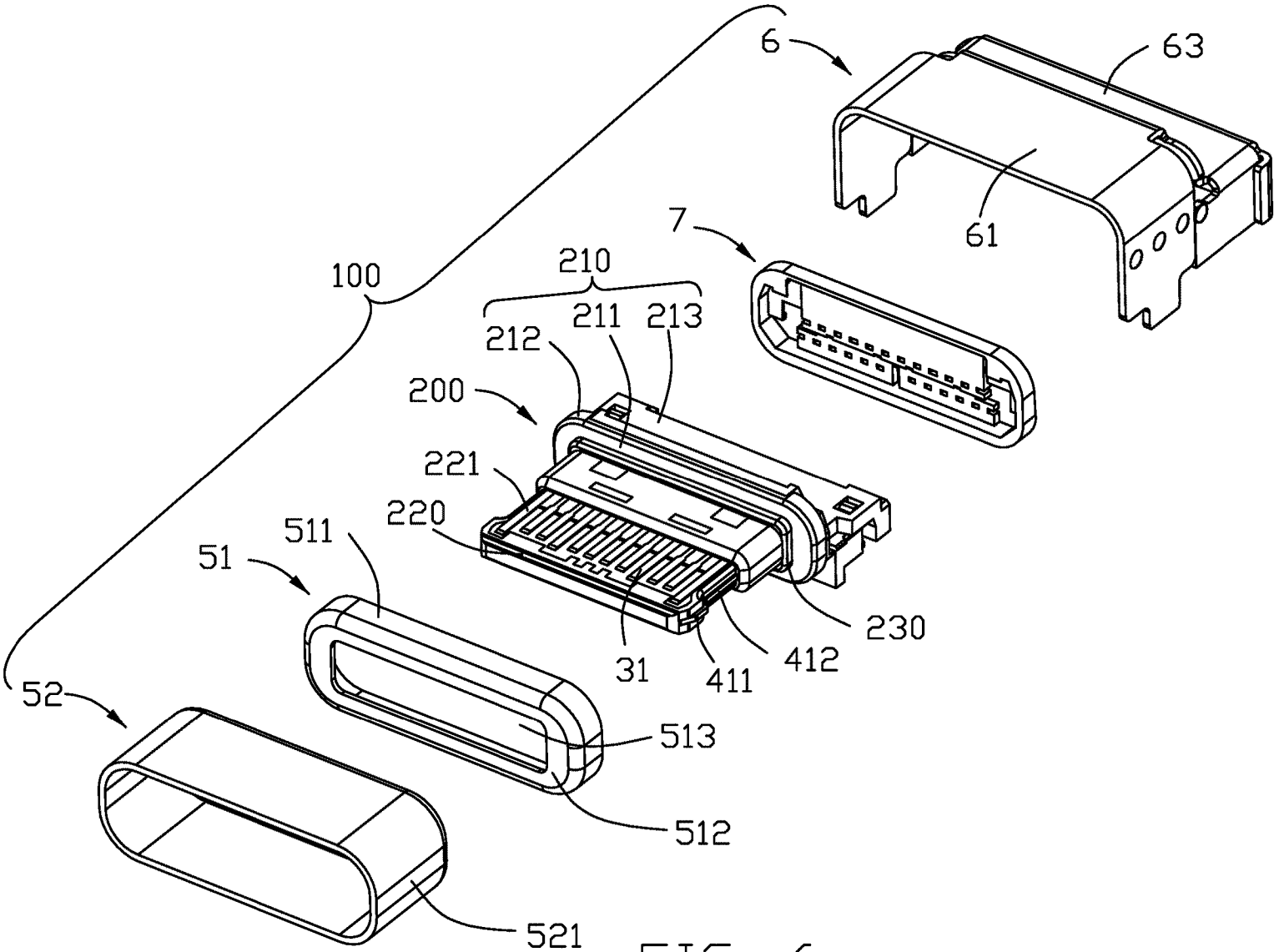
FIG. 6 is a further exploded view of FIG. 3.
Figure 7:
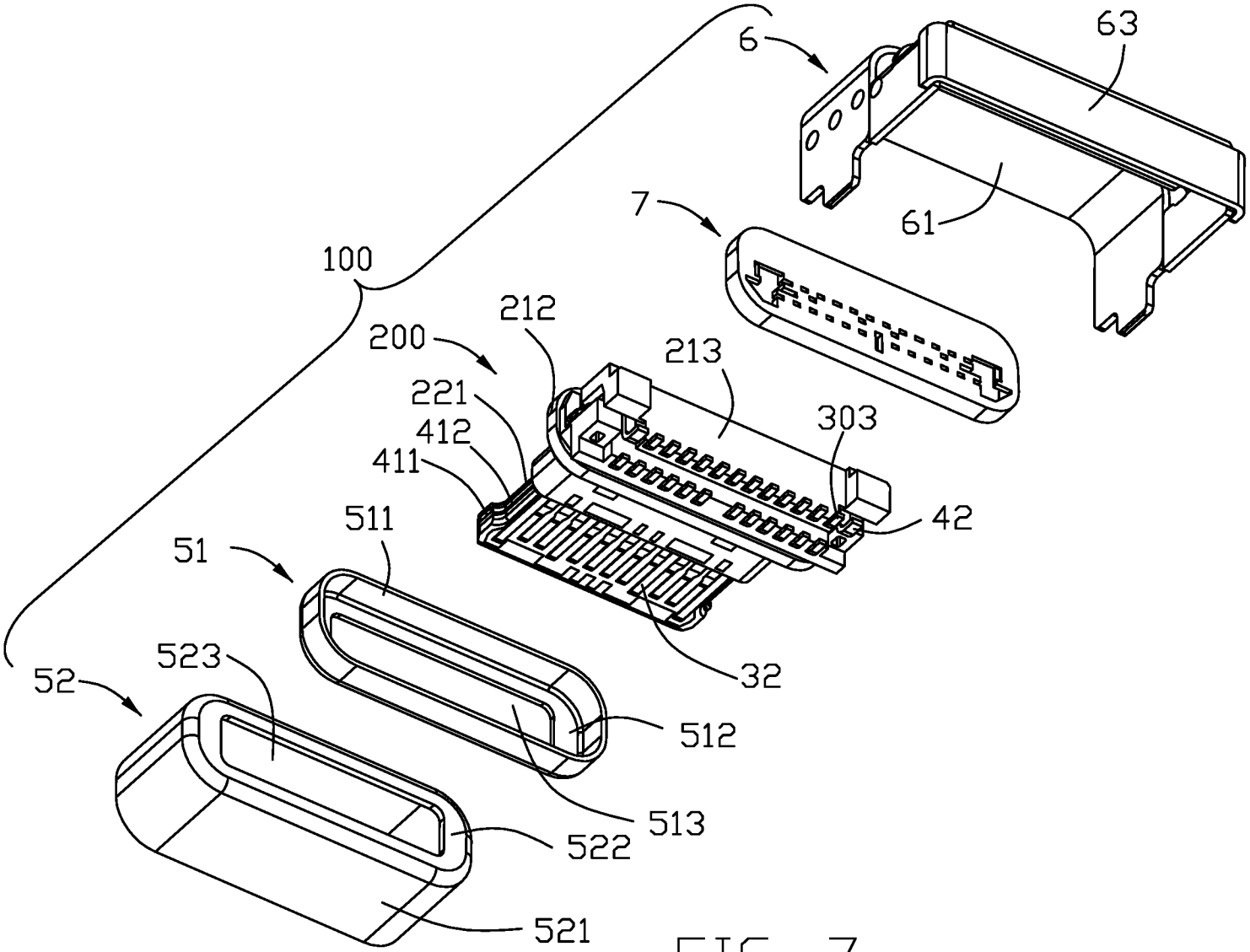
FIG. 7 is a further exploded view of FIG. 4.
Figure 8:
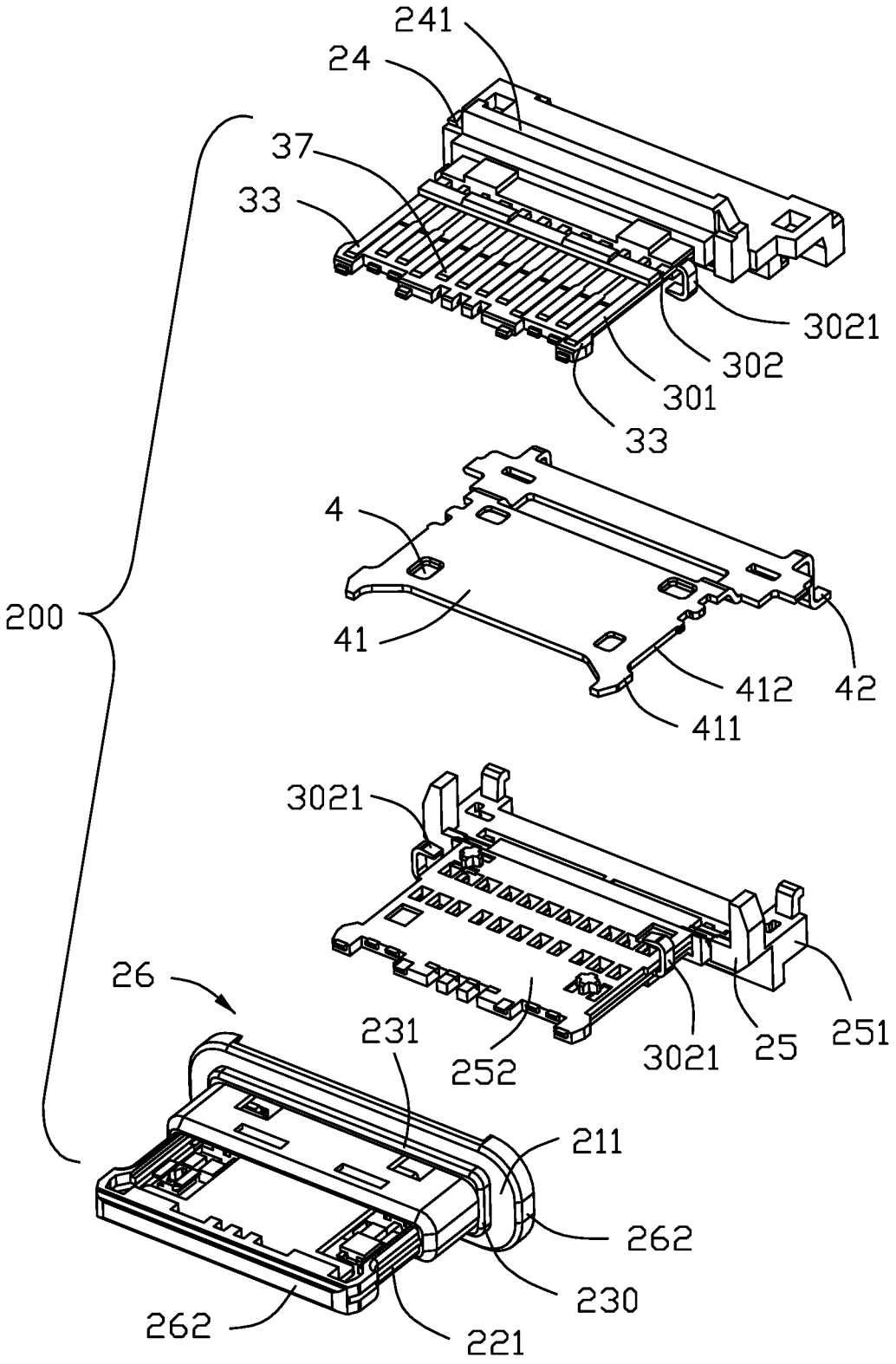
FIG. 8 is a perspective view of a terminal module of the electrical connector.
Figure 9:
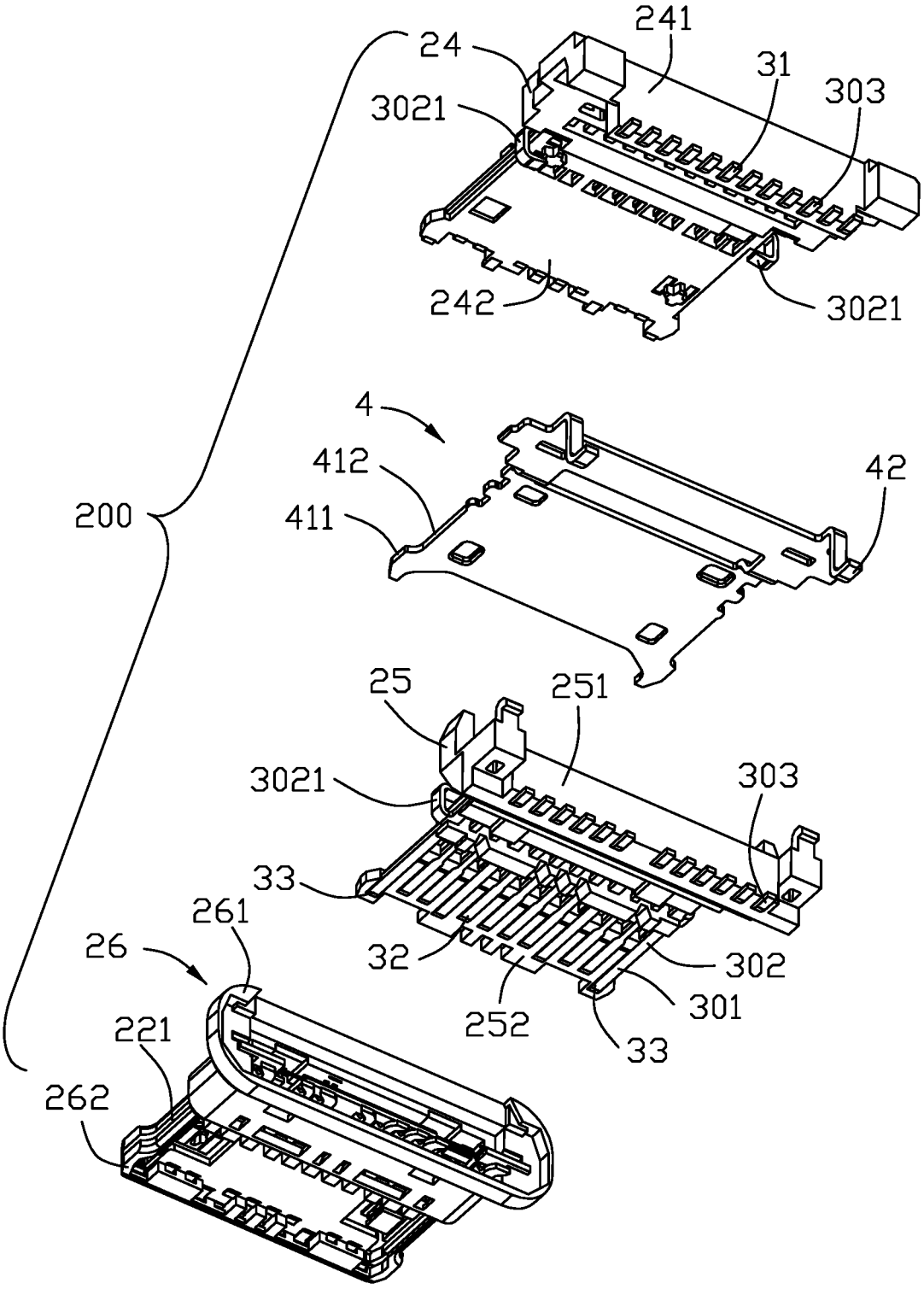
FIG. 9 is another perspective view of the terminal module.

In the embodiment of FIGS. 1 to 12, an electrical connector 100 for mating with a complementary plug connector (not shown) includes a terminal module 200 and a shielding shell 50 enclosing the terminal module. The electrical connector 100 may further include an outer shell 6 affixed to the shielding shell 50 and a sealing member 7 applied to a back of the terminal module. Understandably, the mating direction is defined along the front-to-back direction perpendicular to both the vertical direction and the transverse direction which are mutually perpendicular to each other.

Referring to FIGS. 1-4 and 6-12, the terminal module 200 includes an insulative housing 21 having a base 210 and a tongue 220 and two rows of contacts 30 mounted in the insulative housing and exposed to two opposite surfaces of the tongue. The terminal module 200 may further include a metal plate 4 between the two rows of contacts.

Referring again to FIGS. 6-12, the insulative housing 21 further includes a step 230 between the base 210 and the tongue 220. The base 210 has a front part 212 and a rear part 213. The front part 212 has a front face 211. An upper surface of the rear part 213 is lower than an upper surface of the front part 212. The step 230 has an annular outer surface 231 substantially perpendicular to the front face 211. The tongue 220 has grooves 221. The insulative housing 21 includes an upper unit 24, a lower unit 25, and an over-mold 26. The upper unit 24 has a base part 241 and a tongue part 242; the lower unit 25 has a base part 251 and a tongue part 252; the over-mold 26 includes a base part 261, a tongue part 262, and the step 230.

Referring to FIGS. 8-12, the two rows of contacts of the terminal module 200 include an upper row of contacts 31 secured to the upper unit 24 and a lower row of contacts 32 secured to the lower unit 25. The contacts 30 may be reversely-symmetrically arranged in a town manner for mating in two orientations. Each contact 30 has a contacting portion 301, a securing portion 302, and a soldering portion 303. Each row of contacts may include two outermost ground contacts 33 and each ground contact 33 may further include an engaging portion 3021.

Referring again to FIGS. 6-10, the metal plate 4 includes a main body 41 and two soldering legs 42. The main body 41 has two front corners 411 and two side recesses 412.

Referring to FIGS. 3-7 and 10, the shielding shell 50 includes a rear shell part 51 and a front shell part 52. Each shell part may be formed of an annular portion and a flange by a drawing operation. The rear shell part 51 has a seamless (rear) annular portion 511 and a (rear) flange 512 continuing the seamless annular portion and defining a front opening 513. The annular portion 511 defines a rear opening 5111 and together with the flange 512 defines a (rear) receiving space 5110 for receiving the base 210 therein. The seamless annular portion 511 accommodates the front part 212 of the base 210. The front shell part 52 has a seamless (front) annular portion 521 and a (front) flange 522 continuing the annular portion 521 and defining a rear opening 523. The annular portion 521 defines a front opening 5211 and together with the flange 522 defines a (front) receiving space 5210 which is essentially a mating cavity for receiving a complementary plug connector therein.

Figure 10:
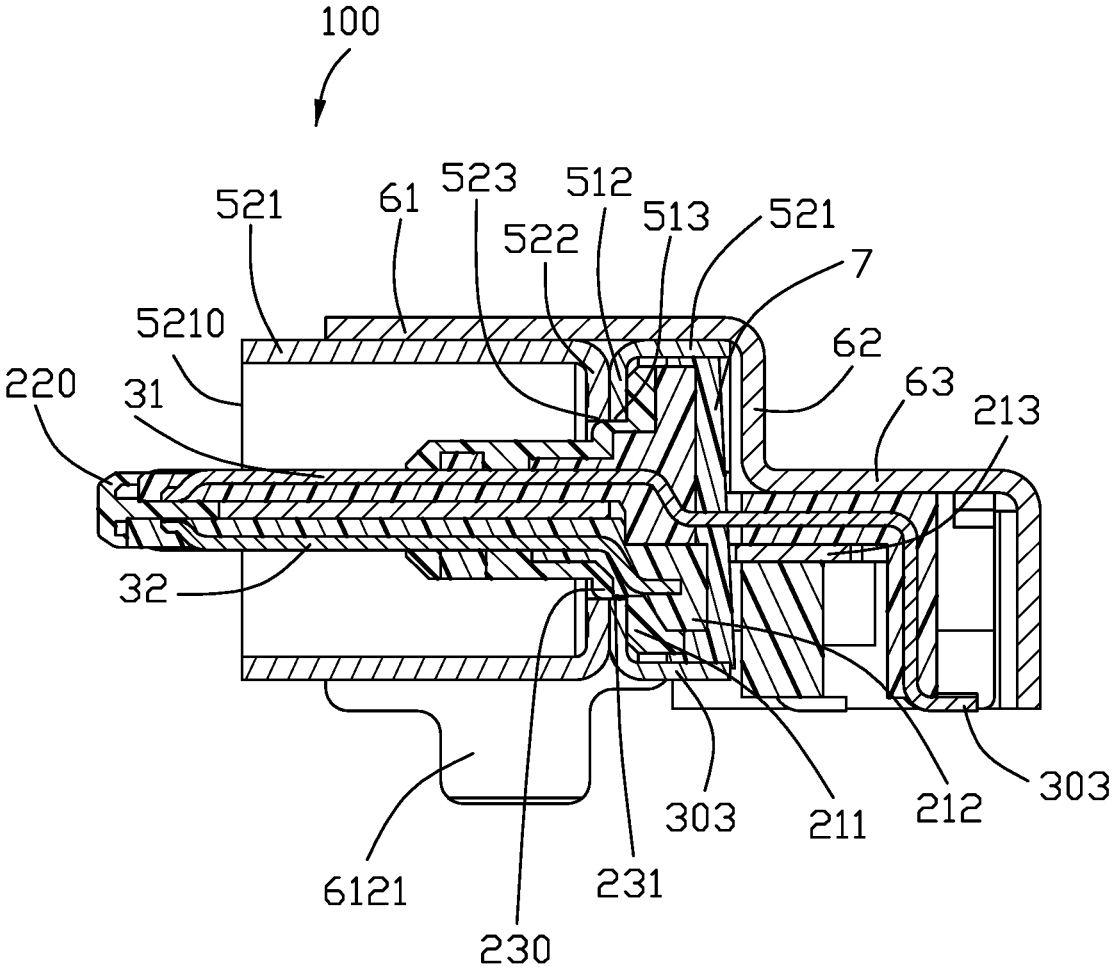
FIG. 10 is a cross-sectional view of the electrical connector taken along line 10-10 in FIG. 1.
Figure 11:
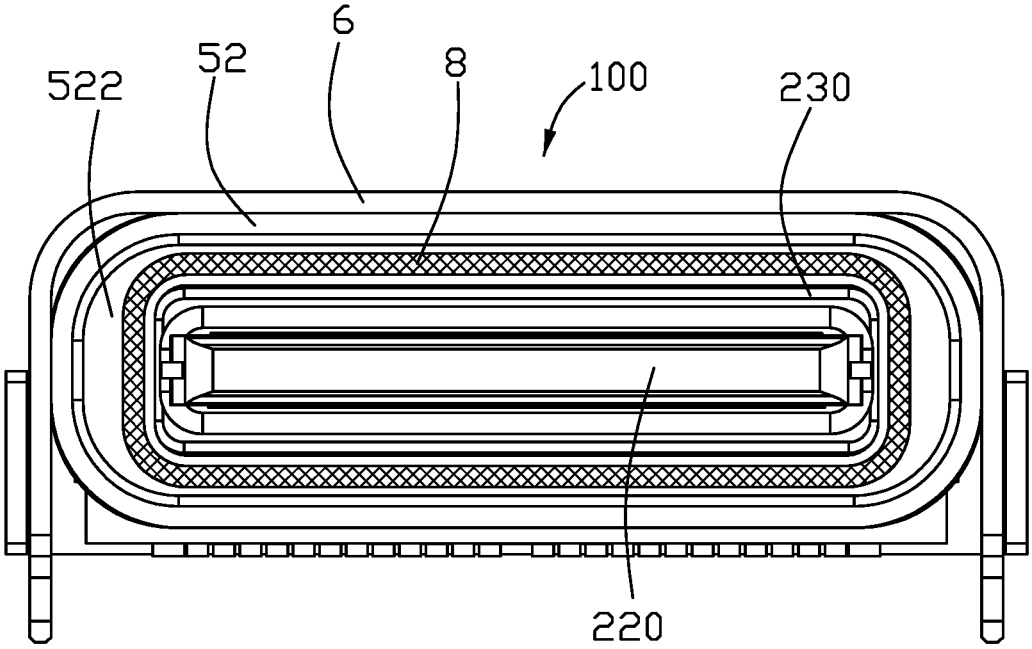
FIG. 11 is a front view of the electrical connector.
Figure 12:
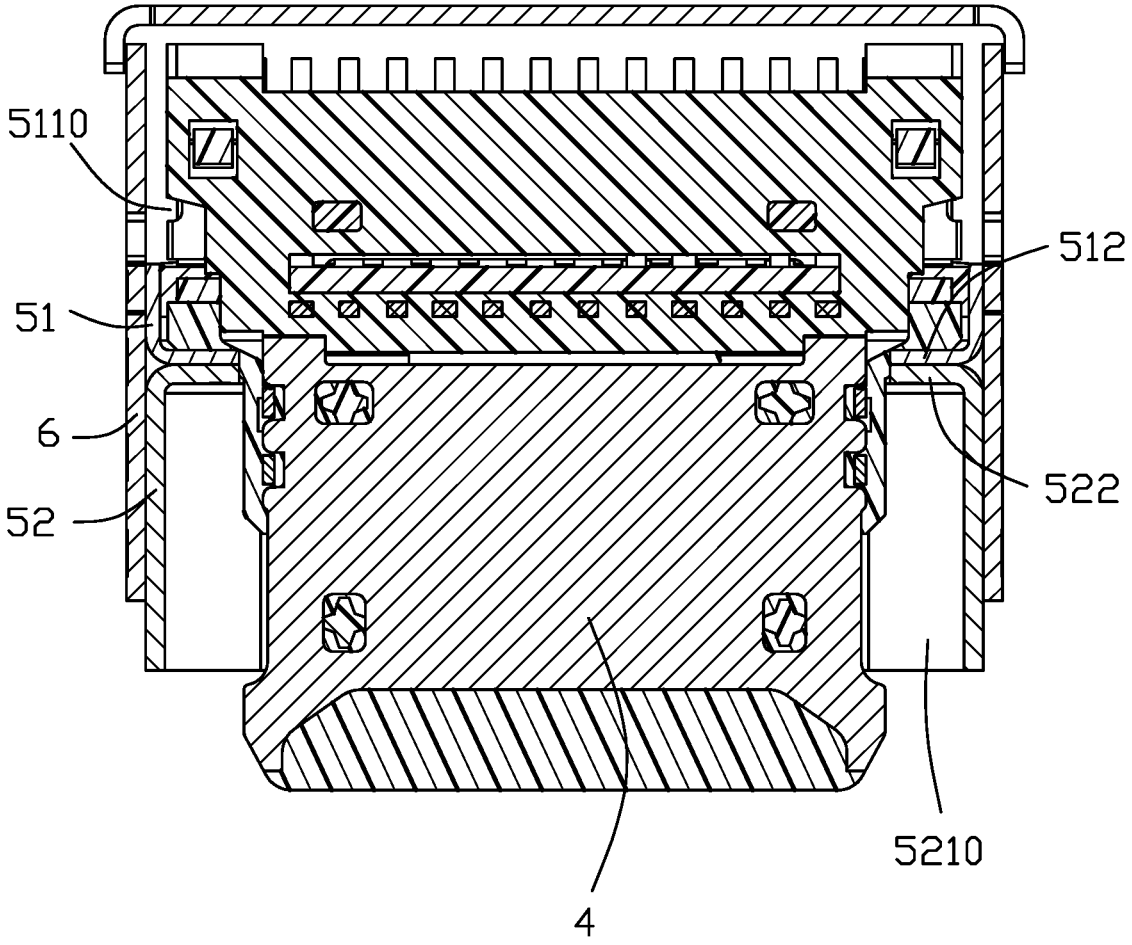
FIG. 12 is a cross-sectional view of the electrical connector taken along line 12-12 in FIG. 1.

Referring to FIGS. 10-12, in this embodiment, the two flanges 512 and 522 of the rear and front shell parts 51 and 52 abut each other in a welding manner. The base 210 may forwardly abut the flange 512.

Referring to FIGS. 1-4, 6-7, and 10, the outer shell 6 includes a front part 61, a rear part 63, and a connecting part 62. The front part 61 has a top wall 611 and a pair of side walls 612. Each side wall 612 has a mounting leg 6121. The rear part 63 has a top wall 631, a pair of side walls 632, and a rear wall 633. Each side wall 612 and a corresponding side wall 632 constitute a wing 64 and the rear wall 633 is forwardly bent at outer sides of the wings.

The upper and lower rows of contacts 31 and 32 are preferably insert molded with corresponding upper and lower units 24 and 25 and then the subassemblies are processed in a manner generally known in this art.

The rear shell part 51 and the front shell part 52 are spot welded at the flange 512 or 522, or in an annular region 8 as shown in FIGS. 11-12.

After inserting the terminal module 200 through the openings 5111, 513, 523, the base 210 abuts the flange 512 and the tongue 220 is situated in the receiving space 5210. At this position, the outer surface 231 of the step 230 engages the flange 512 or the flange 522 or both flanges 512 and 522.

The sealing member 7 is applied to a back of the base 210 in the seamless annular portion 511 of the rear shell part 51 in order to seal any interfacing gap therebetween.

The outer shell 6 is spot welded to the annular portions 511 and 521. In this embodiment, the thickness of the front shell part 52 is larger than that of the rear shell part 51 for mating consideration.

In other embodiments, a sealing ring may be disposed between the step 230 and the flanges 522 and 512 of the front and rear shell parts 52 and 51.

The two front and rear parts of the shielding shell in this invention which back to back abut against each other by the corresponding flanges 522, 512, may be separately formed by a low-cost or inexpensive metal drawing process via sheet metal instead of a more expensive metal injection molding process of forming a one-piece shell. In a structural viewpoint, both the (rear) flange 512 of the rear shell part 51 and the (front) flange 522 of the front shell part 52 commonly form a divider to separate the front receiving space 5210 for receiving the complementary plug connector (not shown) and the rear receiving space 5110 for receiving the base 210 which forwardly abuts against the divider. As mentioned before, on one hand the instant invention is to replace the relatively expensive one piece metal injection molding part as disclosed in the aforementioned U.S. Patent Application Publication No. 2017/0201053. On the other hand, the so-called divider, i.e., the at least one of the flange 510 and the flange 520, is essentially of a complete circumferential or annular configuration which is capable of efficiently preventing EMI (Electro-Magnetic Interference) along the front-to-back direction between the front receiving space 5210 and the rear receiving space 5110. Understandably, the traditional connector as disposed in the aforementioned U.S. Patent Application Publication No. 2016/0181722 fails to form such a complete circumferential or annular divider, thus being interfere to the instant invention from both the electrical viewpoint, i.e., the anti-EMI protection, and the mechanical viewpoint, i.e., not only separating the front receiving space and the rear receiving space but also forming a stopper against which the base abuts forwardly for retention.

What is claimed is:

1. An electrical connector for mating with a plug connector, comprising:

a terminal module including an insulative housing retaining a plurality of contacts therein and including a rear base and a front tongue extending forwardly from the base along a front-to-back direction; and a metallic shielding shell enclosing the housing, and formed by sheet metal, and including a front shell part and a rear shell part discrete from each other but secured to each other in a back-to-back manner with a divider therebetween in said front-to-back direction; wherein said front shell part forms a front receiving space in front of the divider for receiving the complementary plug connector, and said rear shell part forms a rear receiving space behind the divider to receive the base therein.

2. The electrical connector as claimed in claim 1, wherein said front shell part and said rear shell part are secured to each other at the divider.

3. The electrical connector as claimed in claim 2, wherein a thickness of the front shell part is larger than another thickness of the rear shell part.

4. The electrical connector as claimed in claim 1, wherein the front shell part includes a front annular portion extending along the front-to-back direction and a front flange unitarily extending from a rear edge of the front annular portion in a vertical plane, and the rear shell part includes a rear annular portion extending along the front-to-back direction and a rear flange unitarily extending from a front edge of the rear annular portion in another vertical plane and abutting against the front flange in the front-to-back direction to commonly form said divider.

5. The electrical connector as claimed in claim 4, wherein said front flange defines an annular configuration, and said rear flange defines another annular configuration.

6. The electrical connector as claimed in claim 4, wherein the base forwardly abuts against the rear flange in the front-to-back direction.

7. The electrical connector as claimed in claim 4, further including a metallic outer shell attached upon both the front shell part and the rear shell part and covering a rear side of the base.

8. The electrical connector as claimed in claim 4, wherein the front flange forms an opening and the rear flange forms another opening aligned with said opening in the front-to-back direction, both of which the tongue forwardly extends through in the front-to-back direction.

9. The electrical connector as claimed in claim 4, wherein said front flange inwardly extends in said vertical plane, and said rear flange inwardly extends in said another vertical plane.

10. An electrical connector comprising:

a terminal module including an insulative housing retaining a plurality of contacts therein and including a rear base and a front tongue extending forwardly from the base along a front-to-back direction; and a metallic shielding shell enclosing the housing, and formed by sheet metal via a drawing process, and including a front shell part and a rear shell part with a divider therebetween in said front-to-back direction; wherein said front shell part forms a front receiving space in front of the divider for receiving the complementary plug connector, and said rear shell part forms a rear receiving space behind the divider to receive the base therein.

11. The electrical connector as claimed in claim 10, wherein the front shell part includes a front annular portion and the rear shell part includes a rear annular portion, a thickness of the divider in the front-to-back direction is roughly twice a thickness of either the front annular portion or the rear annular portion.

* * * * *